US008719975B2

(12) United States Patent
Phillips et al.

(10) Patent No.: US 8,719,975 B2
(45) Date of Patent: May 13, 2014

(54) SHOWER SYSTEM AND APPARATUS

(71) Applicants: Alec Phillips, Goshen, NY (US); Bart Phillips, Winter Springs, FL (US)

(72) Inventors: Alec Phillips, Goshen, NY (US); Bart Phillips, Winter Springs, FL (US)

( * ) Notice: Subject to any disclaimer, the term of this patent is extended or adjusted under 35 U.S.C. 154(b) by 25 days.

(21) Appl. No.: 13/632,832

(22) Filed: Oct. 1, 2012

(65) Prior Publication Data

US 2014/0090165 A1 Apr. 3, 2014

(51) Int. Cl.
*A47K 3/28* (2006.01)

(52) U.S. Cl.
USPC ..... 4/597; 4/559; 4/605

(58) Field of Classification Search
USPC ..... 4/559, 596, 597, 605
See application file for complete search history.

(56) References Cited

U.S. PATENT DOCUMENTS

2004/0107496 A1* 6/2004 Brunelle et al. ..... 4/597

* cited by examiner

*Primary Examiner* — Tuan N Nguyen
(74) *Attorney, Agent, or Firm* — Michael A. Blake

(57) ABSTRACT

A shower system comprising: an enclosure, the enclosure comprising: at least one interior wall; at least one exterior wall; an opening; a floor; a top; an exterior power button located on an exterior wall and configured to turn the shower system on or off; a control panel located on an interior wall; a thermostatic valve located on an interior wall, a mirror located on an interior wall; an overhead light attached to the top, and configured to stay on about one minute after powering off, the overhead light in communication with the exterior power button and the control panel; audio speakers located at the top, and in communication with the control panel and exterior power button, and configured with the control panel to provide audible alerts including indicating when the shower system has achieved the proper preselected water temperature; and a phone system in communication with the control panel.

18 Claims, 6 Drawing Sheets

SHOWER SYSTEM AND APPARATUS

TECHNICAL FIELD

The present invention generally relates to shower systems and apparatuses, and more specifically to a shower system and apparatus designed to make showering easier and safer for the elderly and/or handicapped.

BACKGROUND

Showers can present unique hazards to the elderly and handicapped. Showers may be difficult to enter and exit, and have slipping hazards. The water temperature may accidently be turned too hot and cause injury to a user. A user may become hurt in the shower, and not have a way of communicating his or her distress. The shower may have poor lighting, and lead to injuries due to the user not being able to see hazards.

Thus there is a need for a shower system and/or apparatus that overcomes the above listed and other disadvantages.

SUMMARY

The disclosed invention relates to a shower system comprising: an enclosure, the enclosure comprising: at least one interior wall; at least one exterior wall; an opening; a floor; a top; an exterior power button located on an exterior wall and configured to turn the shower system on or off; a control panel located on an interior wall; a thermostatic valve located on an interior wall, a mirror located on an interior wall; an overhead light attached to the top, and configured to stay on about one minute after powering off, the overhead light in communication with the exterior power button and the control panel; audio speakers located at the top, and in communication with the control panel and exterior power button, and configured with the control panel to provide audible alerts including indicating when the shower system has achieved the proper preselected water temperature; a phone system in communication with the control panel, and the control panel configured to allow a user to make calls via the phone system.

The invention is also related to a shower control panel, the shower control panel comprising: a front side; a processing system inside the control panel, a keypad located on a front side of the control panel; an illuminated LED screen located on the front side of the control panel; a power button; a top shower control button; a shower spray control button; a shower wand control button; a radio button; tuning controls; volume controls; an aux button; a telephone button; an intercom button; a keypad with a star button, numbers 0-9, and # button; where the processing system is configurable to communicate with: audio speakers and configurable to provide audible alerts through the audio speakers including indicating when the shower water temperature has achieved a preselected water temperature and warning of water temperatures exceeding memorized water temperature; a phone system, and further configurable to allow a user to make calls via the phone system; an intercom system, and configurable to allow a user to communicate via the intercom system; a radio; a non-radio electronic audio device; where the processing system is configured to display current water temperature, radio or other electronic operation; telephone incoming call, intercom incoming communication, and where the processing system is further configured such that when a preselected button or key on keypad is pressed for about 3 seconds the current shower water temperature measurement is saved for subsequent shower use.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
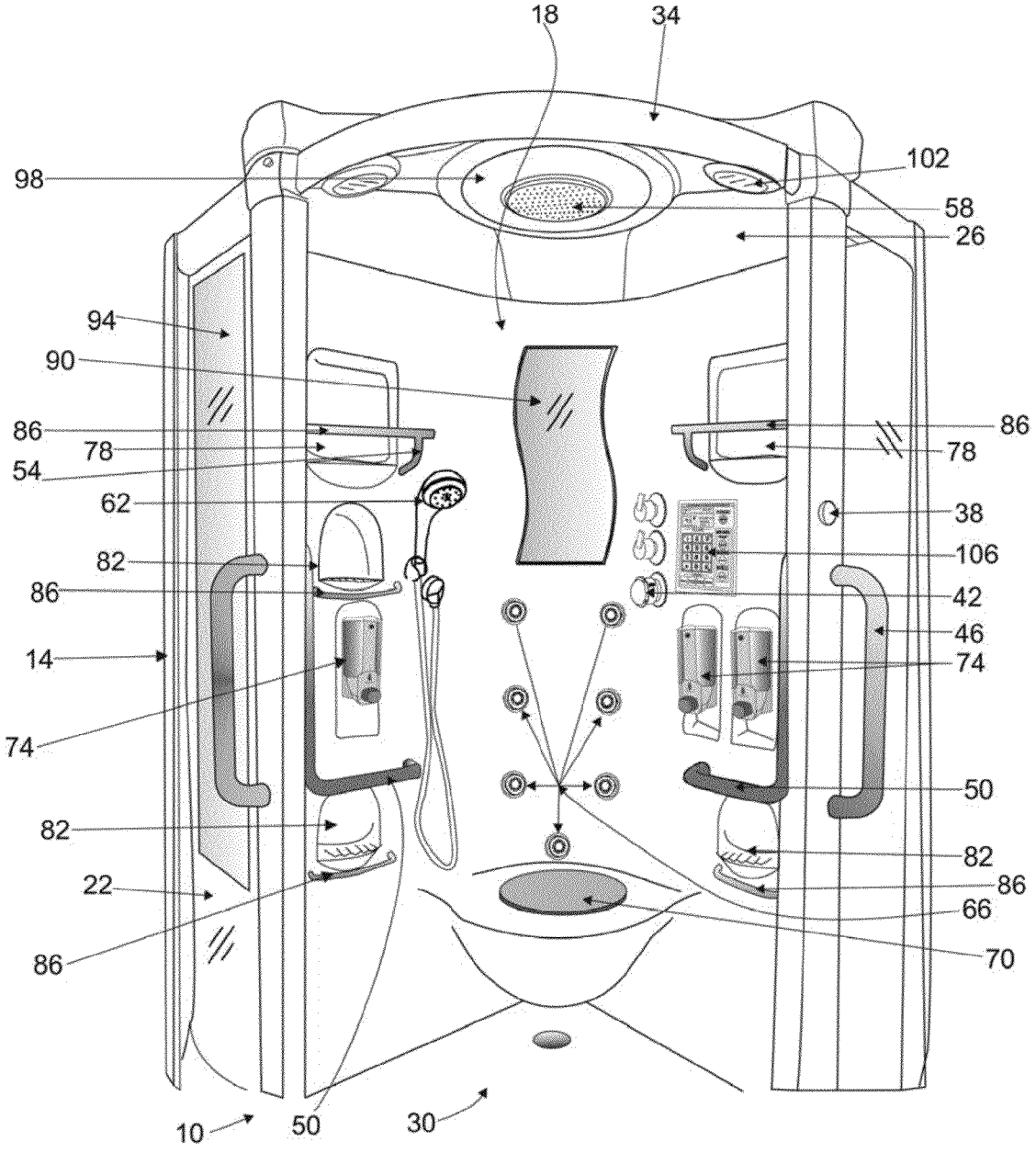
FIG. 1 is a front view of the shower system.

The shower system 10 is generally shown in FIG. 1. The shower system 10 comprises a generally rectangular enclosure 14 with one or more interior walls 18 and one or more exterior walls 22. Of course in other embodiments, the enclosure may be circular, oval, square, or any suitable shape. The enclosure 14 has an opening 26, a floor 30, and top 34. Near the opening 26 is an exterior power button 38. The exterior power button 38 can turn on the water to all shower water outlets in order to flush through the system putting the shower in a ready mode so that the water temperature will be correct when the user steps into the shower. On the interior wall 18 is a thermostatic valve 42. The thermostatic valve is an anti-scalding safety feature. In order to increase the temperature of the water in the shower system 10, the user must press the safety release member to unlock the thermostatic valve 42. The hot and cold water temperature is controlled with the thermostatic valve by turning the knob in one direction for hot water, and in another direction for cold water. The water pressure knob 43 above the thermostatic valve 42 only adjusts the water pressure from jet sprays 66, this may be used if the user has sensitive skin, or prefers a harder or softer spray. The main water pressure valve 44 above that turns on the main water pressure for the entire system. After this is turned on the first time, it may remain opened. After the main water pressure valve 44 is turned on, then the water controls for the shower system 10 may be controlled exclusively by the control panel 106, namely the "TOP" 182, "HAND" 186, and "WALL" 190 buttons on the control panel turns the water on and off at these points. If the water pressure valve 44 is turned off; no water will spray when any of these 3 buttons are pushed. The control panel does not change the temperature of the water. In one embodiment, the control panel 106 remembers the temperature where the thermostatic valve's position was physically left. The same temperature will be reached again if the thermostatic valve has not been moved. The control panel alerts the user when that temperature has been reached again, thus indicating the water temperature is at a user's preselected temperature. The control panel also gives an audible warning of water temperatures exceeding memorized water temperature by three degrees.

Exterior grab bars 46 are located on the exterior walls 22 and near the opening. Lower interior grab bars 50 are located on the interior walls 18 and near the padded seat 70. The lower interior grab bars 50 may be generally "L" shaped and may be reinforced and located to help users maneuver from sitting to standing position or visa-versa. Upper interior grab bars 54 are located on the interior walls 18, and may be used as towel racks. A shower head 58 is attached to the top 34. The shower head 58 may be a rain shower type of shower head with a wide area that can cover a large volume with water. The shower system 10 may also have a shower wand 62 connected to an interior wall by a hose. There may be a plurality of jet sprays 66 located on an interior wall 18. The jet sprays may provide for a massage to the user, and there is a separate pressure valve 43 for the jet sprays 66 to allow a user to increase or decrease the water pressure of the jet sprays The shower system 10 may have a seat 70 attached to one or more interior walls 18. The seat 70 may be padded or cushioned. There may be one or more Soap/shampoo/bodywash dispensers 74 attached to the interior wall. The soap/shampoo/bodywash dispensers 74 may have a push button operation, which is especially useful for those with difficulty in opening a shampoo or body wash bottle, and or holding a bar of soap. The button on the dispensers 74 shall mean a physical button that allows fluid to come out of the dispenser, or may be an electronic button or switch, or a key or icon on a touchscreen controller, or a key on a keypad. There is no electronic button or system for the soap dispensers. There may be one or more shelves 78 located in the interior wall 18 of the shower system 10. There may be one or more soap dishes 82 located on the interior wall 18. In the disclosed embodiment, the soap dishes 82 are recessed into the interior wall, and one is located on the right side of the seat 70, and the other is located on the left side of the seat 70. The soap dishes 82 may be located so they are at a height that is convenient for a person standing to use. There may be one or more small towel racks 86 located throughout the shower on the interior wall 18. In the embodiment shown, two of the towel racks 86 are located at seating level below the two lower soap dishes 82 and two other towel racks 86 are located higher on the interior wall 18 and can also act as upper grab bars to the left and right of the seat 70 while the user is standing. There is a mirror 90 located on the interior wall 18. The mirror 90 may be located above the seat 70. Another mirror 94 is located on the exterior wall 22. The mirror 94 may provide a reflective surface for both the exterior of the shower and the interior of the shower. These mirrors 90, 94 may be located at a height for use while standing and/or sitting. The shower system 10 also comprises an overhead light 98. The overhead light 98 may be configured to turn on when a power switch is turned on, and may be further configured to stay on about one minute after powering off to ensure that the user has enough light while making his exit from the shower. The shower system may also have audio speakers 102 located on the top 34 of the shower system 10. The audio speakers may each be 15 watt audio speakers and configured to provide audio for Hands Free Telephone, Intercom, Voice Confirmation Function, Radio and Auxiliary in stereo. The shower system has a control panel 106 located on an interior wall 18. In one embodiment, the control panel is the "brain" of the shower system 10. The control panel may comprise a processing system. The processing system may include, but is not limited to a computer system including central processing unit (CPU), display, storage and the like. The computer system may include, but not be limited to, a processor(s), computer(s), controller(s), memory, storage, register(s), timing, interrupt(s), communication interface(s), and input/output signal interfaces, and the like, as well as combinations comprising at least one of the foregoing. For example, the computer system may include signal input/output for controlling and receiving signals from the exterior power button. All automation and communication may be controlled from the large, easy to read buttons and keypad on the control panel 106. The buttons on the control panel 106 shall mean an electronic button; or a key, icon, or representation of a button on a touchscreen controller; or a key on a keypad The control panel 106 may have an illuminated LED screen that is configured to show which functions are being used and their values if any.

Figure 2:
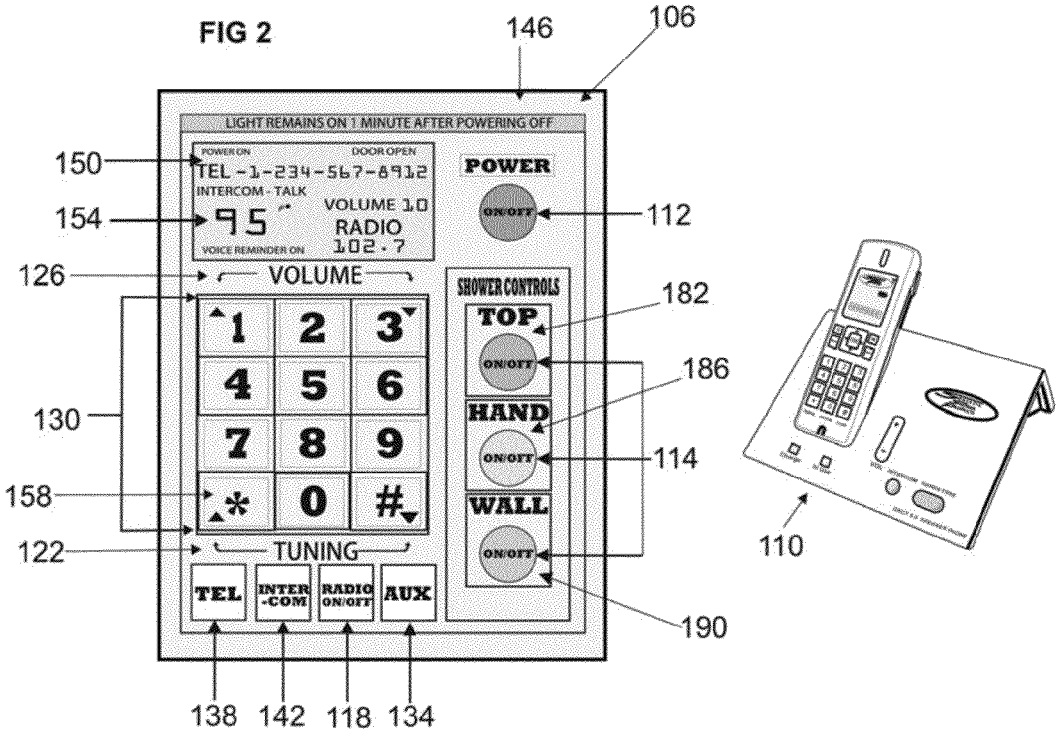
FIG. 2 is a front view of the control panel and a perspective view of a phone system.

FIG. 2 shows the control panel 106 and an optional telephone 110 with which the control panel may be in wireless or wired communication with. The control panel 106 has a power button 112. The power button 112 is configured to turn the entire shower system 10 on and off. The water control buttons 114 control the water coming from the shower jets 66, overhead shower head 58, and hand wand 62. One button (TOP) 182 controls the shower head 58, one button (HAND) 186 controls the shower wand 62, and one button (WALL) 190 controls the jet sprays 66. A radio button 118 turns the radio on and off. Tuning controls 122 and volume controls 126 are shown on the keypad 130. The control panel 106 can have station presets. An Aux button 134 turns on and off an auxiliary device configured to communicate with the control panel 106 including but not limited to a cd player, mp3 player, or other music or sound delivery device. There is also a telephone button 138. The shower system 10 includes a hands-free telephone built into the control panel 106 with an additional optional phone base and handset 110. Phone Base and a Handset. The hands free telephone may use SP-1 DECT 6.0 Digital Phone System technology which ensures clear and secure voice quality using FSK and DTMF dual Caller ID systems. The hands free telephone can be very valuable for a user experiencing trouble while in the shower allowing the user to call 911. There is an intercom button 142. An intercom is integrated into the phone system. When the intercom button 142 is pressed, it allows the user to call out or answer an incoming intercom call from the SP-1 Dect 6.0 Phone Base/Intercom or the Handset/Intercom. This may be vital for users who desire privacy while under assisted care. Located in the control panel 106 is a voice confirmation function 146. Voice confirmations come from the shower speakers 102, which gives an audio confirmation of any of the commands inputted into the control panel, confirms functions, and provides warnings. The volume is adjustable. Below is a list of possible audio confirmations that the system will provide:

Power on
Power off
Telephone on
Telephone off
Intercom on
Intercom off
Radio on
Radio off
Auxiliary on
Auxiliary off
The temperature is ready
Caution, the temperature has exceeded the desired setting The control panel 110 has a display 150. On the display, a water temperature 154 is visible and can be programmed by the user. The water temperature for the shower can be memorized by the user by holding the star button 158 on the key pad 130 for 3 seconds in one embodiment. Thus, the next time the user turns on the shower, the voice confirmation function will alert the user that that the memorized water temperature has been achieved and the shower is ready for use at the proper temperature.

Figure 3:
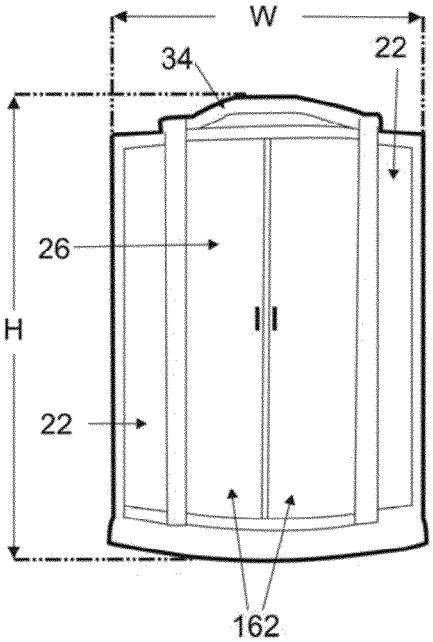
FIG. 3 is a front view of the shower enclosure.

FIG. 3 shows one embodiment of the shower system 10. In this view, the exterior walls 22, top 34, and shower doors 162 over the opening 26 are shown. In this embodiment, the height H of the shower system may be about 87 inches, and the width W may be about 60 inches. However, different heights and widths are within the scope of this disclosure.

Figure 4:
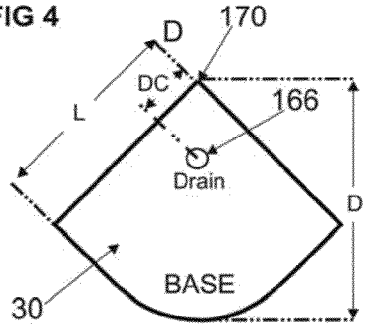
FIG. 4 is a top view of the shower floor.

FIG. 4 shows one embodiment of the shower floor 30. A drain 166 is shown in the floor 30. The shower floor 30 may have a partial rectangle shape as shown; however, other shapes will fall into the scope of this disclosure. The floor Depth D may be about 51 inches, and the floor side length L may be about 42 inches. The drain center may be a distance $D_{DC}$ from an apex 170 of the floor, and D may be about 10 inches.

Figure 5:
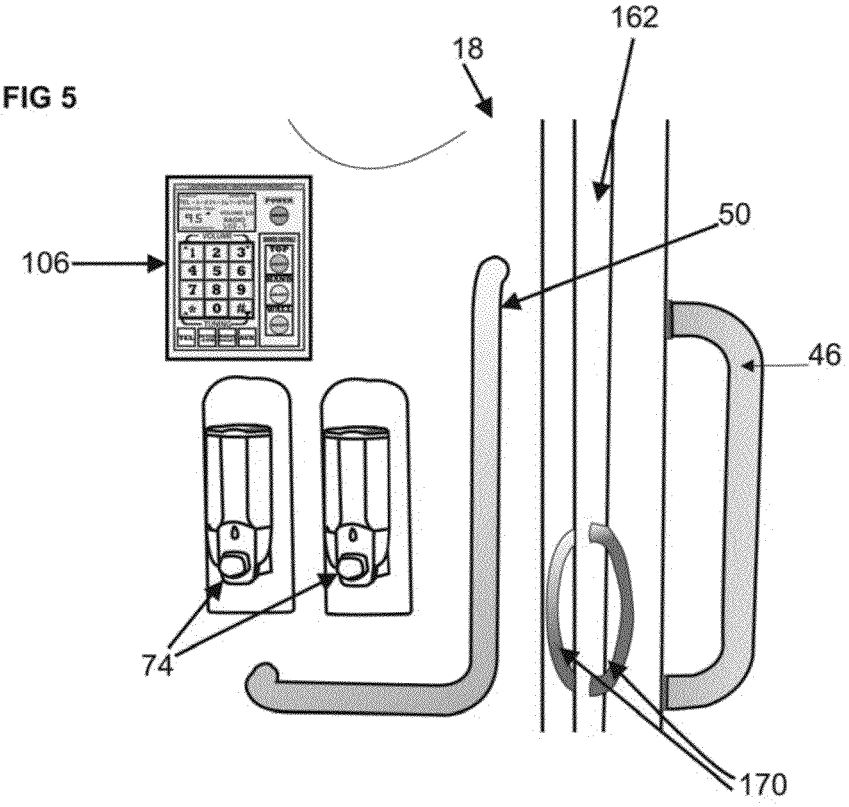
FIG. 5 is a detail view of an interior wall adjacent to the control panel.

FIG. 5 is a more detailed view of the interior wall 18 adjacent to the control panel 106. The shower door 162 is shown in this view as is a pair of shower door handles 170. The lower interior grab bars are "L" shaped in this embodiment. The "L" shaped grab bars 46 are particularly useful to help users maneuver from sitting to standing and/or visa-versa.

Figure 6:
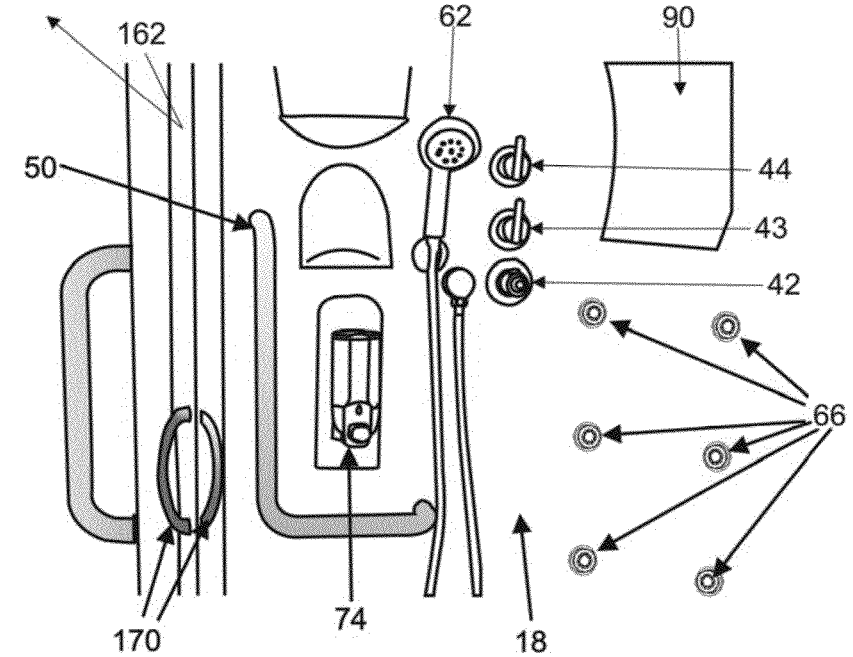
FIG. 6 is a detail view of an interior wall adjacent to the shower wand.

FIG. 6 is a more detailed of an interior wall 18 adjacent to the shower wand 62. In this embodiment, adjacent to the shower wand 62 are shower wand is the thermostatic valve 42, the water pressure knob 178, and the main water pressure valve 174.

One way of using the disclosed shower system is for a user to press the exterior power button 38 to turn on power and disperse water through all water lines (e.g. the overhead shower 58, the shower wand 62, and jet sprays 66). The voice confirmation system 146 will activate and say "The temperature is ready", or something related, once the temperature has reached its preselected temperature. At this point the user may press the exterior power button 38 again turning the system off but leaving it in a "ready" mode. The ready mode is achieved by pushing the exterior power button a second time after hearing the voice confirmation telling you "the temperature is ready"; your shower temperature is "ready" or "set" for you to then enter. The user may enter using the exterior grab bars 46 and the "L" shaped grab bars 50 to help the user sit in the padded seat 70. The user may now press the control panel power button 112 which turns the system back on. The user may now select one or more of the three choices of shower sprays located on the control panel consisting of TOP (overhead shower 58), HAND (hand held shower wand 62) or WALL (jet sprays 66). The user can use the intercom button 142 to communicate with someone else in his home (or wherever his intercom system is configured for), or the telephone button 138 to call 911 in an emergency. In addition, the user may play the radio using the radio button 118 or a CD or other device using the AUX button 134.

Figure 7:
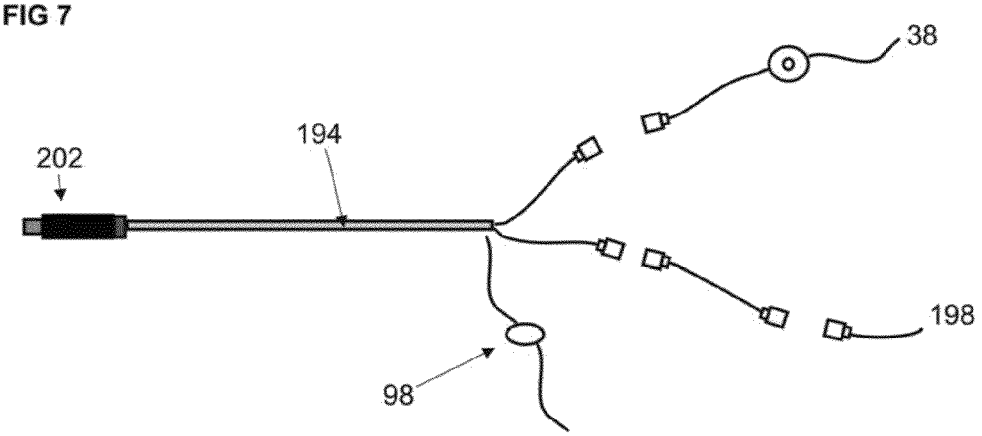
FIG. 7 is a schematic view of the overhead light line.

FIG. 7 shows a wiring schematic. Overhead light line 194 is shown. The line is in communication with the exterior power button 38, and the overhead light 98. In addition, the line 194 is also in communication with a temperature sensor 198. The overhead light line 194 is in communication with the control panel 106 via connector 202.

Figure 8:
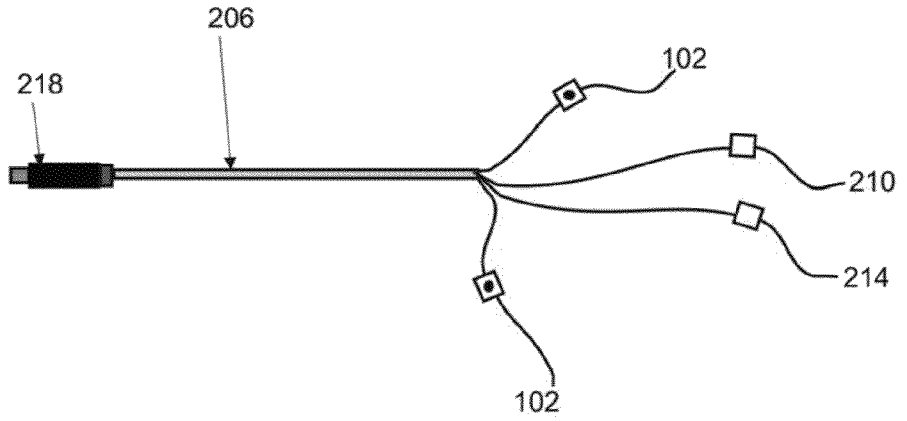
FIG. 8 is a schematic view of the speaker line.

FIG. 8 shows a wiring schematic for the speaker line 206. The speaker line is in communication with a first speaker 102 and a second speaker 102, and a first door sensor 210 and a second door sensor 214. In one embodiment there may be one line (wire) that connects to two sensors 210, 214 so one of the wires runs in series. The door sensors 210, 214 can tell when the shower doors are opened or closed. The speaker line 206 is in communication with the control panel 106 via connector 218.

Figure 9:
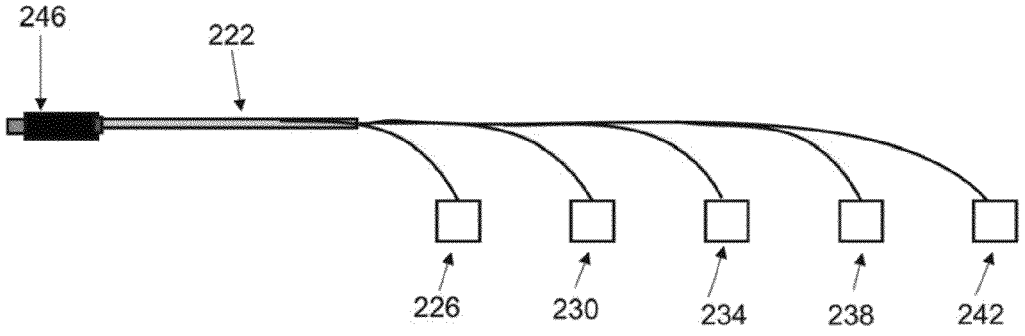
FIG. 9 is a schematic view of the solenoid line.

FIG. 9 shows a wiring schematic for the solenoid line 222. The solenoid line 222 is in communication with a cold water solenoid 226, a hot water solenoid 230, a jet spray solenoid 234, a shower wand solenoid 238, and a shower head solenoid 242. The solenoid line 222 is in communication with the control panel 106 via connector 246.

Figure 10:
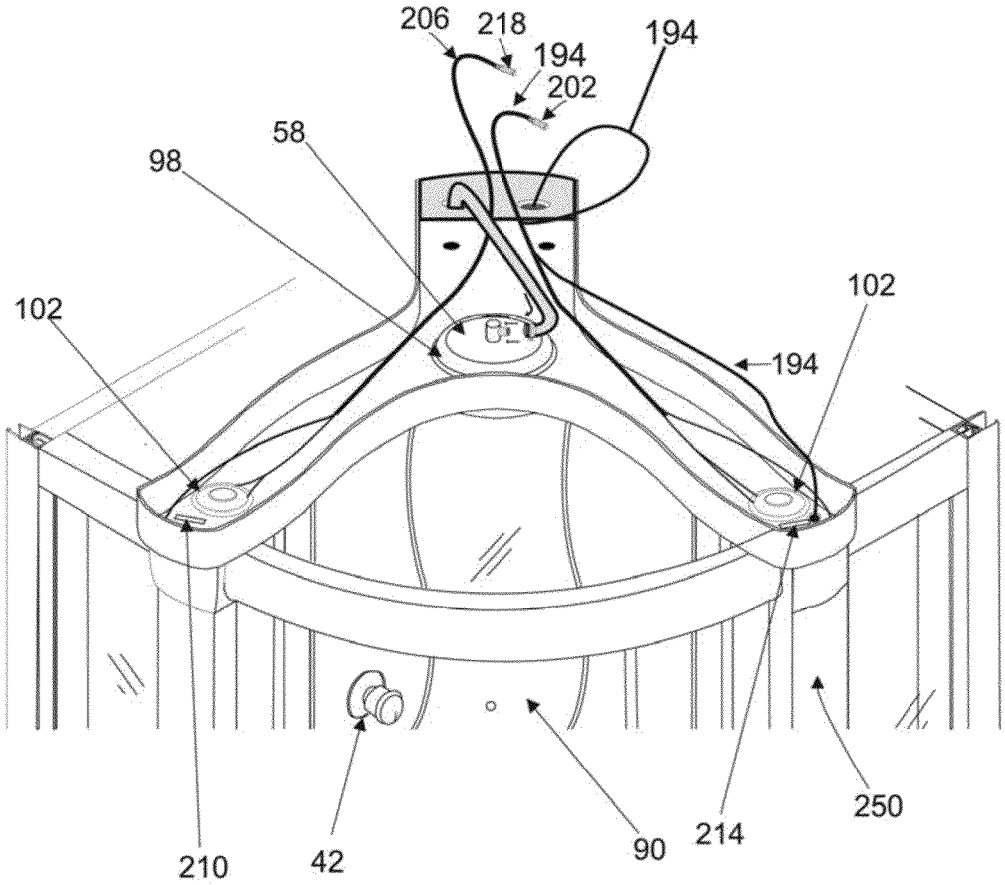
FIG. 10 is a top view of the shower system.

FIG. 10 shows the top 34 of the shower system 10. The overhead light line 194 is shown connected to the overhead light 98. The overhead light line 194 splits to so that the line 194 runs down a right pillar where it connects to the exterior power button 38 (not visible in this view). The overhead light line 194 has another split that runs down behind the interior wall 18 where the line 194 connects to a temperature sensor 198 (the sensor 198 not visible in this view). Speaker line 206 is shown connecting to the speakers 102. The overhead light line also connects to the first and second door sensors 210, 214.

Figure 11:
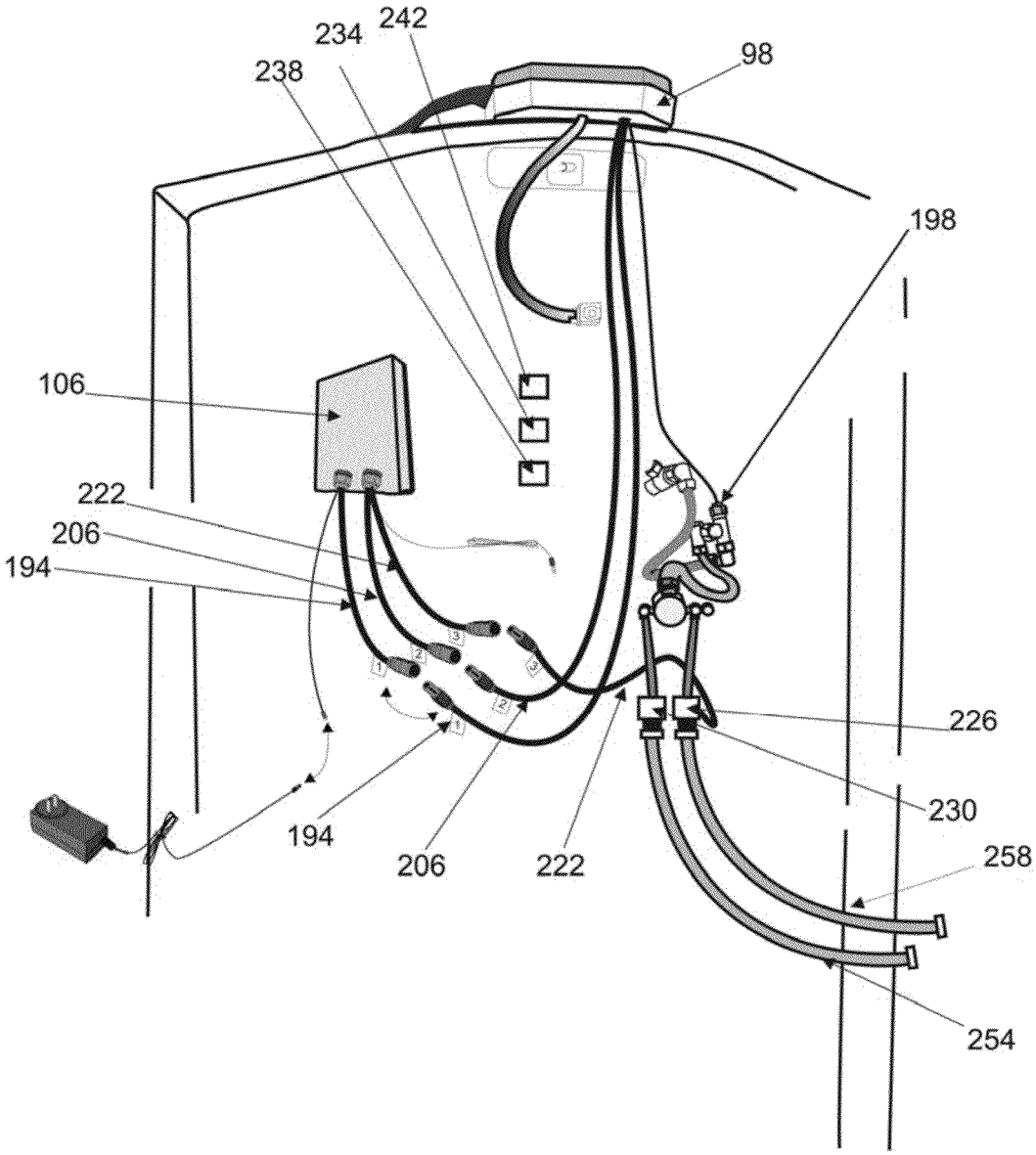
FIG. 11 is a schematic view of the control panel and connections.

FIG. 11 shows a schematic view of how the overhead light line 194, speaker line 206 and solenoid line 222 connect to the control panel 106. A hot water supply line 254 and cold water supply line 258 are shown in connected to the shower system 10. The overhead light line 194 is shown in communication with the overhead light 98 and the temperature sensor 198. The speaker line 206 goes up to the top of the shower system and is in communication with the speakers 102 (not shown in this view) and the door sensors 210, 214 (not shown in this view). The solenoid line 222 is in communication with a cold water solenoid 226, a hot water solenoid 230, a jet spray solenoid 234, a shower wand solenoid 238, and a shower head 242. These solenoids are controllable via the control panel 106. The user, via the control panel, can turn on and off solenoids that control whether water will be supplied by the hot water supply 254, cold water supply line 258, jet sprays 66, shower wand 62, and shower head 58.

In another embodiment, the control panel 106 may be installed or retrofitted on an already existing shower. Thus the control panel 106 would electronically control the water supply in the shower, be wired to a telephone, intercom, radio, and other electronic devices.

The disclosed invention has many advantages. The disclosed shower system is easy to install, free standing shower unit for anyone including those elderly and handicapped people who would like to safely shower independently. It features a state of the art wireless communication system so 911 is readily available for those who are alone or intercom communication when under assisted care. There are many enhancements for those with physical challenges which require special safety precautions. The disclosed invention, depending on the embodiment, may have some or all of the following advantages: a water temperature memory so each shower can be consistently the same; a thermostatic control valve which serves as an anti-scalding safety feature; several reinforced safety grab bars to assist entering, exiting, balance and maneuvering; an easy access control panel conveniently located while sitting or standing with main controls for the entire system; three choices of shower types, Overhead rain shower, Hand held wand, and shower spray jets; an overhead light so shower area is well lit, and the light does not turn off until one minute after turning off the system so the user always has light while exiting, there may be a door sensor which senses when a door is open on the system which automatically relays the information to the control panel which turns off the back wall sprays so water does not spray out of the shower; conveniently located pushbutton bodywash/soap/shampoo dispensers for easy one handed use; shampoo and accessory shelves or either side and for sitting or standing convenience; recessed soap dish trays located for sitting or standing convenience; interior mirrors located for sitting or standing convenience; an exterior mirror; face towel racks conveniently placed for sitting or standing; voice confirmation of functions can be activated so the visually impaired can be signaled which control button was pushed; a radio, good for storm emergencies or just music; an auxiliary input (cd or mp3 input, for example); and volume controls are on the control panel.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A shower system comprising:
an enclosure, the enclosure comprising:
at least one interior wall;
at least one exterior wall;
an opening;
a floor;
a top;
an exterior power button located on an exterior wall and configured to turn the shower system on or off;
a control panel located on an interior wall;
a thermostatic valve located on an interior wall,
a mirror located on an interior wall;
an overhead light attached to the top, and configured to stay on about one minute after powering off, the overhead light in communication with the exterior power button and the control panel;
audio speakers located at the top, and in communication with the control panel and exterior power button, and configured with the control panel to provide audible alerts including indicating when the shower system has achieved the proper preselected water temperature;
a phone system in communication with the control panel, and the control panel configured to allow a user to make calls via the phone system.

2. The shower system of claim 1, further comprising:
an intercom system in communication with the control panel, and the control panel configured to allow a user to communicate via the intercom system.

3. The shower system of claim 2, wherein the phone system and the intercom system are both in wireless communication with the control panel.

4. The shower system of claim 1, further comprising:
a thermostatic valve located on an interior wall, the thermostatic valve configured to prevent the increasing of the shower water temperature unless a safety release is activated.

5. The shower system of claim 1, further comprising:
a plurality of jet sprays located on an interior wall;
a shower wand attached to an interior wall;
a rain-type shower head attached to the top and configured to provide water within the enclosure.

6. The shower system of claim 1, further comprising:
at least one push-button soap/shampoo/bodywash dispenser located on an interior wall.

7. The shower system of claim 1, further comprising a mirror on an interior wall.

8. The shower system of claim 1 further comprising a mirror on an exterior wall.

9. The shower system of claim 1, wherein the audio speakers are 15 watt audio speakers and configured to operate in conjunction with the telephone system and intercom system.

10. The shower system of claim 1, further comprising:
a radio in communication with the control panel, and configured to operate in conjunction with the audio speakers.

11. The shower system of claim 1, further comprising:
a non-radio electronic audio device in communication with the control panel, and configured to operate in conjunction with the audio speakers.

12. The shower system of claim 1, further comprising:
a keypad located on the control panel.

13. The shower system of claim 1 further comprising:
an illuminated LED screen located on the control panel.

14. The shower system of claim 1, wherein the control panel is configured to show current water temperature, radio or other electronic operation; telephone incoming call, intercom incoming communication.

15. The shower system of claim 1, wherein the control panel further comprises:
a power button;
a top shower control button;
a shower spray control button;
a shower wand control button;
a radio button;
tuning controls;
volume controls;
an aux button;
a telephone button;
an intercom button;
a keypad with a star button, numbers 0-9, and # button.

16. The shower system of claim 1, wherein the control panel is configured such that when a pre-programmed button or key on keypad is pressed for about 3 seconds the current shower water temperature is saved for subsequent shower.

17. The shower system of claim 16 further comprising:
a thermostatic valve located on an interior wall, the thermostatic valve configured to prevent the increasing of the shower water temperature unless a safety release is activated;
wherein the system is configures such that when the safety release is activated, a user is only then allowed to increase the water temperature hotter than a certain preset safe water temperature, and a warning from the voice confirmation system will be audible to warn the user if the temperature exceeds the pre-set safe water temperature by about 3 degrees Fahrenheit.

18. A shower control panel, the shower control panel comprising:
a front side;
a processing system inside the control panel,
a keypad located on a front side of the control panel;
an illuminated LED screen located on the front side of the control panel;
a power button;
a top shower control button;
a shower spray control button;
a shower wand control button;
a radio button;
tuning controls;
volume controls;
an aux button;

a telephone button;

an intercom button;

a keypad with a star button, numbers 0-9, and # button;

wherein the processing system is configurable to communicate with:

audio speakers and configurable to provide audible alerts through the audio speakers including indicating when the shower water temperature has achieved a preselected water temperature;

a phone system, and further configurable to allow a user to make calls via the phone system;

an intercom system, and configurable to allow a user to communicate via the intercom system;

a radio;

a non-radio electronic audio device;

wherein the processing system is configured to display current water temperature, radio or other electronic operation; telephone incoming call, intercom incoming communication, and wherein the processing system is further configured such that when a pre-programmed button or key on keypad is pressed for about 3 seconds the current shower water temperature is saved for subsequent shower use.

* * * * *